US006667586B1

(12) United States Patent
Blau

(10) Patent No.: US 6,667,586 B1
(45) Date of Patent: Dec. 23, 2003

(54) VARIABLE FREQUENCY ELECTRONIC BALLAST FOR GAS DISCHARGE LAMP

(75) Inventor: David Arthur Blau, 23005 Standing Oak Ct., Cupertino, CA (US) 95014

(73) Assignee: David Arthur Blau, Cupertino, CA (US)

( * ) Notice: Subject to any disclaimer, the term of this patent is extended or adjusted under 35 U.S.C. 154(b) by 0 days.

(21) Appl. No.: 10/233,877

(22) Filed: Sep. 3, 2002

(51) Int. Cl.[7] ..... G05F 1/00; H05B 37/02
(52) U.S. Cl. ..... 315/291; 315/307
(58) Field of Search ..... 315/224, 291, 315/307, DIG. 4, DIG. 7

(56) References Cited

U.S. PATENT DOCUMENTS

| | | | | |
|---|---|---|---|---|
| 4,700,113 A | * | 10/1987 | Stupp et al. | 315/224 |
| 5,051,662 A | | 9/1991 | Counts | 315/247 |
| 5,103,139 A | | 4/1992 | Nilssen | 315/219 |
| 5,402,043 A | | 3/1995 | Nilssen | 315/307 |
| 5,469,028 A | | 11/1995 | Nilssen | 315/291 |
| 5,568,041 A | | 10/1996 | Hesterman | 323/207 |
| 5,677,602 A | * | 10/1997 | Paul et al. | 315/224 |
| 5,798,615 A | | 8/1998 | Gasparini et al. | 315/219 |
| 5,825,137 A | * | 10/1998 | Titus | 315/291 |
| 5,949,199 A | | 9/1999 | Qian et al. | 315/307 |
| 6,072,282 A | | 6/2000 | Adamson | 315/276 |
| 6,091,210 A | | 7/2000 | Cavolina | 315/307 |
| 6,118,224 A | | 9/2000 | Murakami et al. | 315/244 |
| 6,137,238 A | * | 10/2000 | Alvarez et al. | 315/291 |
| 6,255,785 B1 | | 7/2001 | Yang et al. | 315/291 |
| 6,259,215 B1 | * | 7/2001 | Roman | 315/307 |

* cited by examiner

*Primary Examiner*—Don Wong
*Assistant Examiner*—Minh A
(74) *Attorney, Agent, or Firm*—David R. Gildea

(57) ABSTRACT

An electronic ballasts for a gas discharge lamp. The ballast includes a variable frequency power generator, a tuned driver network, and a valley correction modulation system. The driver network has a first resonant frequency when the lamp is off and a second resonant frequency when the lamp is on. The power generator switches a rectified AC power line signal at a starting lamp frequency corresponding to the first resonant frequency for starting the lamp and at an operating lamp frequency corresponding to the second resonant frequency for operating the lamp. The valley correction modulation system compensates for the cyclic low voltages of the AC power line voltage cycle by adjusting the operating lamp frequency to be closer to the second resonant frequency.

38 Claims, 9 Drawing Sheets

VARIABLE FREQUENCY ELECTRONIC BALLAST FOR GAS DISCHARGE LAMP

BACKGROUND OF THE INVENTION

1. Field of the Invention

The invention relates generally to electronic ballasts for gas discharge lamps and more particularly to a self-starting electronic ballast having a first resonant frequency for starting a lamp and a second resonant frequency for operating the lamp.

2. Description of the Prior Art

An ionized high intensity discharge (HID) light, such as a high power Sodium or Halide lamp, uses an electronic ballast for converting the frequency of a public utility AC line power to a higher frequency in order to drive the lamp. The ballast must first start the lamp at a very high voltage and then run the lamp at a much lower voltage.

Ballasts are commonly evaluated on the basis power efficiency, power factor, lamp lifetime,, and cost. Common existing ballasts have power efficiencies of about 80% and power factors of about 0.9. Several attempts have been made to improve upon these figures. Unfortunately, these attempts have not been entirely successful and they have sometimes resulted in decreased lamp life. In some cases high voltage and high power FET switches have been used. However, these switches add significantly to the cost of the ballast. Moreover, existing ballasts commonly use ferromagnetic devices that are so heavy, for example 30 pounds, that they are costly to ship and difficult install.

There is a continuing need for an improved ballast for HID applications.

SUMMARY OF THE INVENTION

It is therefore an object of the present invention to provide a ballast providing high power efficiency, high power factor and long lamp life with a low weight at a low cost.

Briefly, in a preferred embodiment, a ballast of the present invention includes a variable frequency power generator, a lamp driver network, and a valley fill correction system. The power generator switches a rectified AC power line signal for providing a high frequency generator signal at a first or starting lamp frequency to start an HID lamp and a second or operating lamp frequency to operate the lamp. The driver network uses first and second resonant frequencies of an inductor and several capacitors for boosting the generator signal to start and then operate the lamp. The valley fill correction system fills the low voltages (valleys) in the rectified AC power cycle with voltage pedestals and further boosts the operating current to the lamp during the valley time periods by frequency modulating the generator signal.

An advantage of the present invention is that a single inductor having a moderate weight is used for providing the drive signals for both starting and operating an HID lamp.

Another advantage of the present invention is that the cyclic low voltages of the AC power line voltage cycle are compensated by adjusting a generator signal closer to a resonant frequency for boosting lamp current without significantly decreasing power factor.

Another advantage of the present invention is that a power generator has a low cost and a high power efficiency by operating at the relatively low voltage of a rectified AC power line signal and driving a resonant circuit for providing a high voltage generator signal to a lamp.

These and other objects and advantages of the present invention will no doubt become obvious to those of ordinary skill in the art after having read the following detailed description of the preferred embodiments which are illustrated in the various figures.

IN THE DRAWINGS

DETAILED DESCRIPTION OF THE PREFERRED EMBODIMENTS

Figure 1:
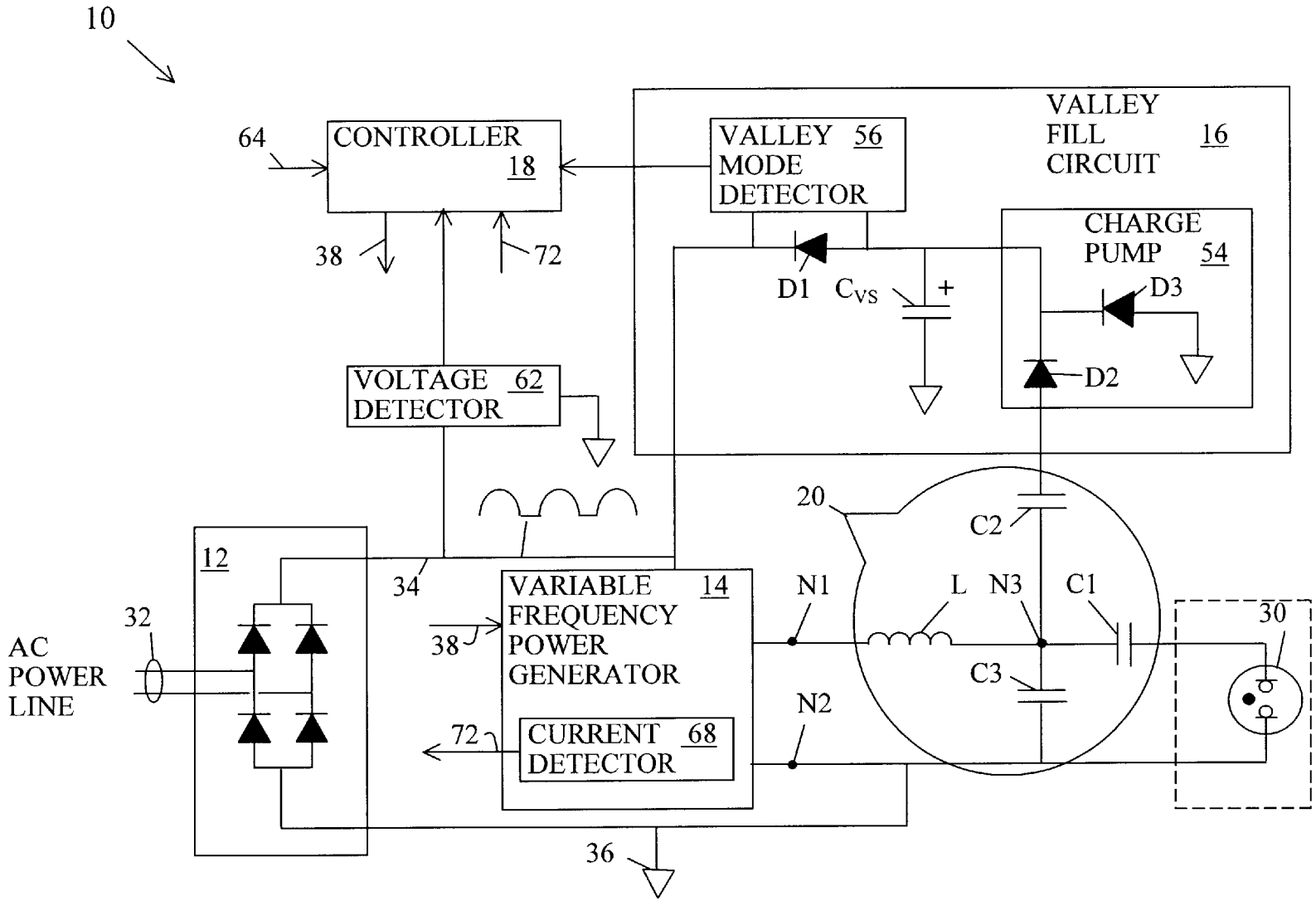
FIG. 1 is an electrical diagram of a ballast of the present invention for powering a lamp.

FIG. 1 illustrates a ballast of the present invention referred to by a general reference number 10. The ballast 10 includes a line rectifier 12, a variable frequency power generator 14, a valley fill circuit 16, a controller 18, and a tuned lamp driver network 20. The driver network 20 includes an inductor L, a first capacitor C1, a second capacitor C2, and a third capacitor C3. The object of the ballast 10 is to start and operate a gas discharge lamp 30.

The line rectifier 12 receives alternating current (AC) voltage typically in a range of 200 to 304 rms or 300 to 450 peak volts from an AC power line 32 and provides a rectified voltage on a line 34 with respect to a circuit common 36. Without a valley fill correction as described below, the rectified voltage has cyclic low voltages 37 (FIG. 3) corresponding to the portions of the AC power signal cycle that are close to the zero crossings of the AC power line cycle.

The rectified voltage on the line 34 is received by the power generator 14. The power generator 14 switches the rectified voltage from the line 34 on and off for providing a generator signal across circuit nodes N1 and N2. The node N2 also connects to the circuit common 36. The inductor L connects between the node N1 and a resonating circuit node N3. The first capacitor C1 connects between the node N3 and one side of the lamp 30. The other side of the lamp 30 connects to the node N2. The lamp 30 has a high impedance when it is off and a low impedance when it is on. The second capacitor C2 connects between the node N3 and the valley fill circuit 16. The third capacitor C3 connects between the node N3 and the node N2

The generator signal from the variable frequency power generator 14 has a lamp power frequency that is controlled by a frequency control signal, denoted by a reference number 38. The frequency control signal 38 is provided by the controller 18. In order to reduce the physical sizes of the inductor L and capacitors C1–3, the lamp frequency is much higher than the frequency of the AC power line 32.

Figure 2B:
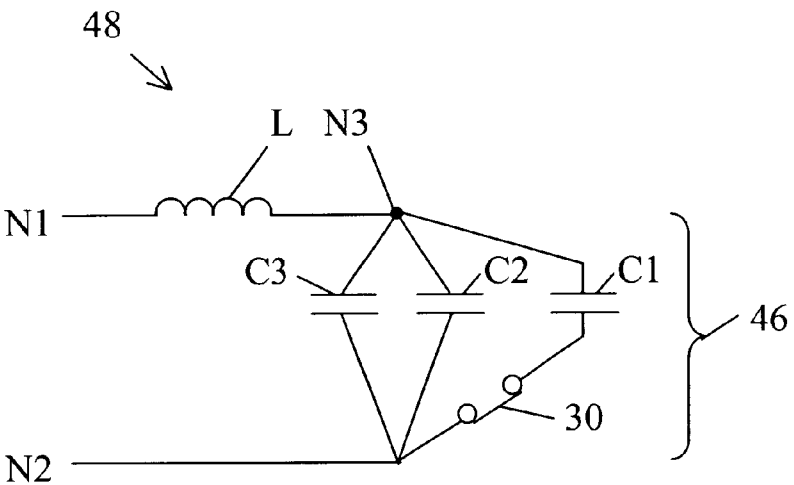
FIG. 2A and 2B are circuit diagrams of a lamp driver network of the ballast of FIG. 1 for starting and operating the lamp, respectively.
Figure 2A:
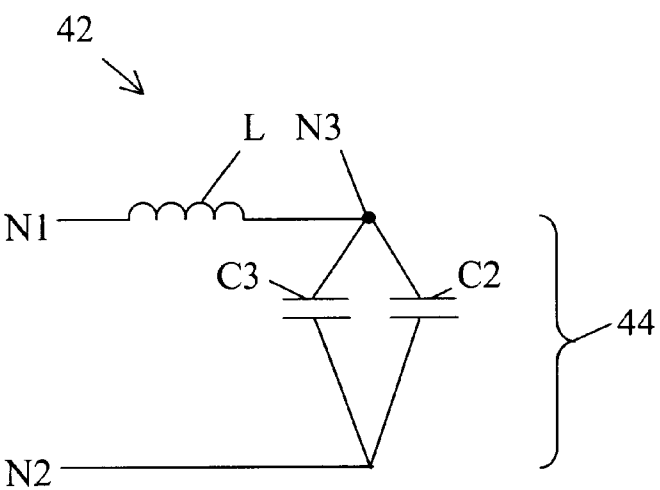

Referring to FIGS. 2A and 2B, before ignition when the lamp 30 is off, a starting serial circuit 42 is formed between the nodes N1 and N2 by an inductance of the inductor L in series with an effective capacitance 44 between the nodes N3 and N2. The starting serial circuit 42 has a first resonant frequency termed a "starting resonant frequency". The effective capacitance 44 is approximately the parallel combination of the second and third capacitors C2 and C3. After ignition when the lamp 30 is conducting, the first capacitor C1 is added in parallel to the second and third capacitors C2 and C3 to form an effective capacitance 46 between the nodes N3 and N2. An operating serial circuit 48 between the nodes N1 and N2 is formed by the inductance of the inductor L and the effective capacitance 46. The operating serial circuit 48 has a second resonant frequency termed an "operating resonant frequency".

In order to start or ignite the lamp 30, the controller 18 sets the frequency control signal 38 so that the power generator 14 provides a first or starting lamp frequency that matches the starting resonant frequency within a range of ±10%. Preferably, the starting resonant frequency is in a range of 50 to 500 kHz. The resonance of the inductor L and the effective capacitance 44 provides a very high alternating start voltage between the nodes N3 and N2. The alternating start voltage is passed by the first capacitor C1 to the lamp 30.

When the start voltage becomes high enough, typically about 1000 to 3000 volts peak, gas in the lamp 30 breaks down (ignites) and the lamp 30 begins to conduct. When the lamp 30 is conducting, the starting serial circuit 42 is replaced by the operating serial circuit 46. The operating resonant frequency is lower because the first capacitor C1 now effectively parallels the second and third capacitors C2 and C3.

The change from the serial circuit 42 having the starting resonant frequency to the serial circuit 46 having the operating resonant frequency causes the alternating voltage across the nodes N3 and N2 and across the lamp 30 to drop very rapidly. This reduction in voltage results in a gradual turn on of the lamp 30, thereby avoiding long term damage to the lamp 30 that would result from a more rapid turn on. Preferably, the operating resonant frequency is in a range of 30 to 100 KHz or a range of two to five times lower than the starting resonant frequency. At this lower resonant frequency an alternating operating voltage between the nodes N3 and N2 is much lower than the alternating start voltage. In order to continue to run the lamp 30, the controller 18 gradually adjusts the frequency control signal 38 until the lamp frequency is a second or operating lamp frequency that is slightly away, preferably above, the operating resonant frequency. The operating lamp frequency should be within a range of ±25% of the second or operating resonant frequency.

Figure 4:
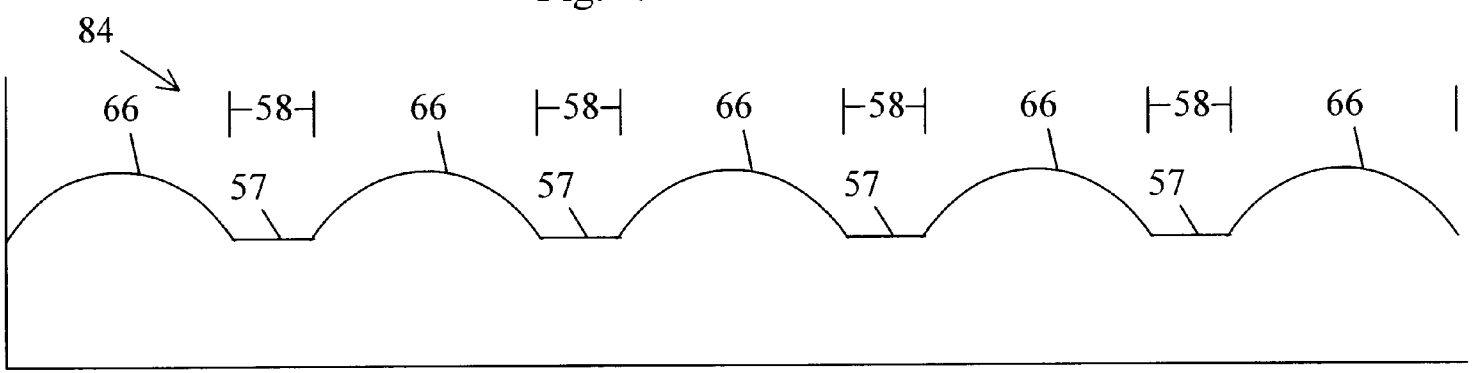
FIG. 4 is a rectified voltage diagram having valley fill correction of the ballast of FIG. 1.
Figure 5:
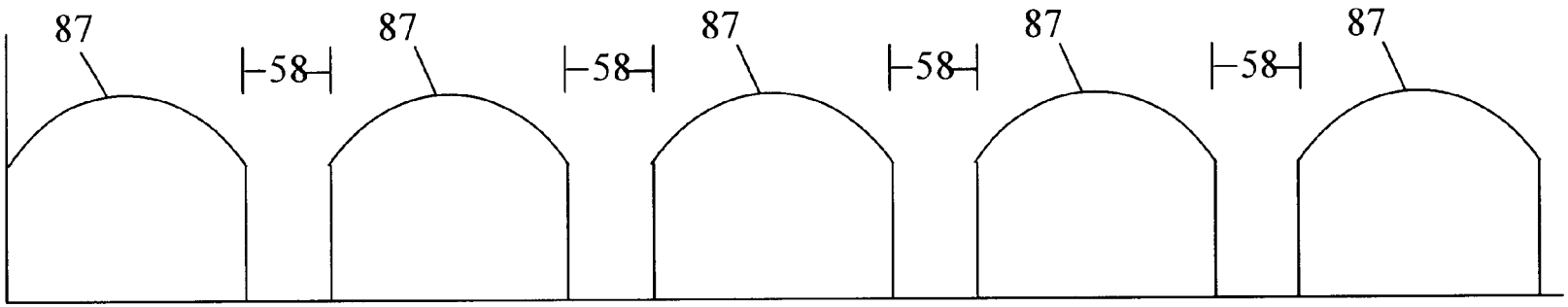
FIG. 5 is a diagram of AC line current without valley fill correction.
Figure 6:
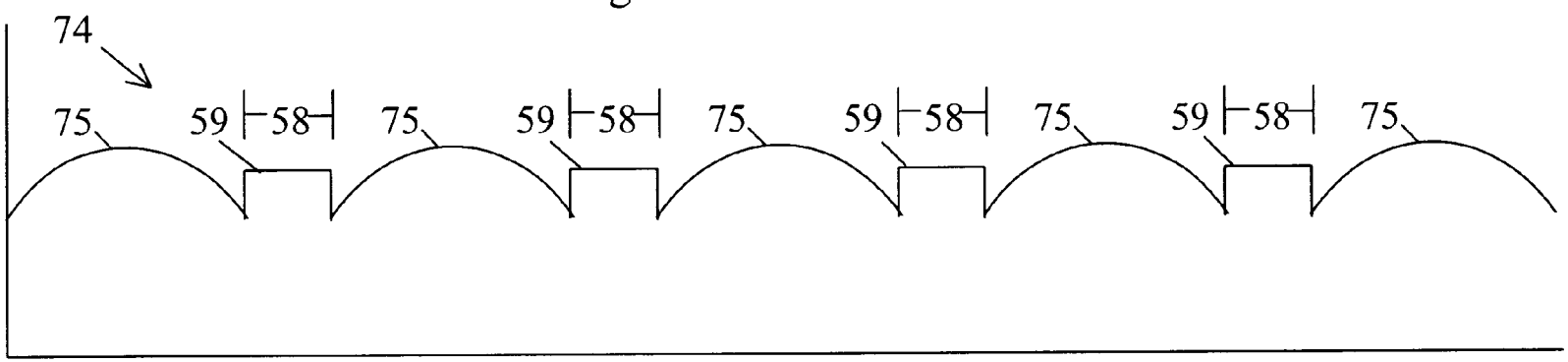
FIG. 6 is a diagram of lamp current having valley fill correction of the ballast of FIG. 1.

The valley fill circuit 16 includes a charge pump 54, a valley storage capacitor $C_{VS}$, a rectifier D1, and a valley mode detector 56 for providing a valley fill correction. The second capacitor C2 acts as series capacitor for passing an input or feedback current from the node N3 to the charge pump 54. The charge pump 54 includes diodes D2 and D3 for pumping charge onto the valley storage capacitor $C_{VS}$ for providing a valley fill correction voltage. In operation, the valley fill correction voltage on the capacitor $C_{VS}$ is typically one-fourth to one-half the peak rectified voltage on the line 34. When the rectified voltage on the line 34 is less than the voltage on the valley storage capacitor $C_{VS}$, the rectifier D1 passes a valley fill current to the line 34. The valley fill current results in voltage pedestals 57 (FIG. 4) that cover the cyclic low voltages 37 (FIG. 3) in the rectified voltage on the line 34 during low voltage time period 58 (FIGS. 4, 5, 6).

Referring again briefly to FIGS. 2A–B, the effective in-circuit capacitance of the second capacitor C2 is slightly lower than the capacitance of the second capacitor C2 measured by itself due to a small range of voltages when neither of the diodes D2–3 is conducting. However, because sum of the diode voltage drops is small compared to the voltages of 600 to 3000 volts between the third circuit node and the second circuit node, the discrepancy is small.

Returning to FIG. 1, the valley fill detector 56 connects to the rectifier D1 to sense the time periods 58 (FIGS. 4, 5, 6) when the valley fill current is flowing, and passes a fill detect signal to the controller 18. Responsive to the fill detect signal, the controller 18 provides valley fill frequency modulation.

The controller 18 provides the valley fill frequency modulation to adjust the frequency control signal 38 to cause the power generator 14 to adjust the lamp frequency of the generator signal toward the operating resonant frequency. The lamp frequency nearer to the operating resonant frequency results in a boost current, denoted by 59 (FIG. 6), to the lamp 30 during the valley fill time periods 58 (FIGS. 4, 5, 6). The boost current 59 (FIG. 6) compensates for the lower voltage level of the voltage pedestals 57 (FIG. 4) in the rectified voltage on the line 34. A further effect of the boost current 59 (FIG. 3) is that the driver network 20 acts as a current source (high impedance) to the lamp 30, thereby providing more consistent drive power than would be provided with a voltage source (low impedance). The more consistent drive power increases the lifetime of the lamp 30 and reduces flicker. The more consistent drive also prevents the lamp 30 from cooling during the low voltages. The cooling of the lamp 30 might otherwise cause the lamp 30 to turn off spontaneously.

The ballast 10 also includes a voltage detector 62 and an external input 64. The voltage detector 62 detects the voltage of the pedestal voltages 57 (FIG. 4) and the average of the high voltages, denoted by 66 (FIG. 4), of the rectified voltage on the line 34 and provides a detected voltage signal to the controller 18. The external input 64 receives information from a user or an external controller. The external controller may include an occupancy detector using motion, sound, heat radiation, or the like, for determining whether there are any human occupants in the vicinity of the lamp 30. The power generator 14 includes a current sensor 68. The current sensor 68 provides a detected current signal, denoted by 72, to the controller 18 for detecting a current, denoted by 74 (FIG. 6), flowing through the nodes N1 and N2. The detected current signal 72 is indicative of the current flowing through the lamp 30. The current 74 has high currents, denoted by 75 (FIG. 6), corresponding to the high voltages 66 (FIG. 4) and boost currents 59 (FIG. 6) during the low voltage times 58 (FIGS. 4, 5, 6).

Programming in the controller 18 monitors the external input 64, the fill detect signal, the detected voltage signal, and the detected current signal 72 for adjusting the frequency control signal 38. The power generator 14 uses the frequency control signal 38 for adjusting the lamp frequency of the generator signal. As the lamp frequency is adjusted toward the operating resonant frequency, the alternating operating voltage between the nodes N3 and N2 increases, thereby increasing the brightness of the lamp 30; and when the lamp frequency is adjusted away from the operating resonant frequency, the alternating operating voltage between the nodes N3 and N2 decreases, thereby dimming the lamp 30.

The controller 18 uses the detected voltage signal to compensate for high and low line levels on the AC power line 32 to provide a constant brightness from the lamp 30. The controller 18 uses the external input 64 to dim or increase the brightness of the lamp 30 in response to a user request and/or an indication of whether the vicinity of the lamp 30 is occupied. The controller 18 uses the average current indicated by the detected current signal 72 for estimating the brightness of the lamp 30 and adjusting the lamp frequency toward or away from the operating resonant frequency in order to adjust the lamp current to set the brightness of the lamp 30 to a desired level. The controller 18 also uses the indication of the boost currents 59 from the detected current signal 72 for adjusting the generator frequency away from the operating resonant frequency if necessary for maintaining a sufficient power factor. Typically, a power factor greater than 0.97 is considered to be sufficient.

The inductor L has an inductance in a range of 50 to 1000 uH (microHenrys). The first capacitor C1 has a capacitance in a range of 0.005 to 0.056 uF (microfarads). The second capacitor C2 has a capacitance in a range of 0.005 to 0.056 uF. The third capacitor C3 has a capacitance in a range of 0.005 to 0.056 uF. In a preferred embodiment, the inductor L is about 270 uH (microHenrys) made with 42T on C—C ED3 core 56/256 wound with Litz wire and weighting about 6 ounces. In a preferred embodiment, the first capacitor C1 is about 0.033 uF (microfarads). The second capacitor C2 is about 0.01 uF. The third capacitor C3 is about 0.01 uF. The valley storage capacitor $C_{VS}$ is an electrolytic type of about 330 uF. A small low power conventional power supply converts AC line power to DC power for powering the circuitry in the ballast 10. A housing for the ballast 10 may be constructed of plastic. The entire weight of the ballast 10 described herein using easily available components is in a range of 2 to 5 pounds.

Figure 3:
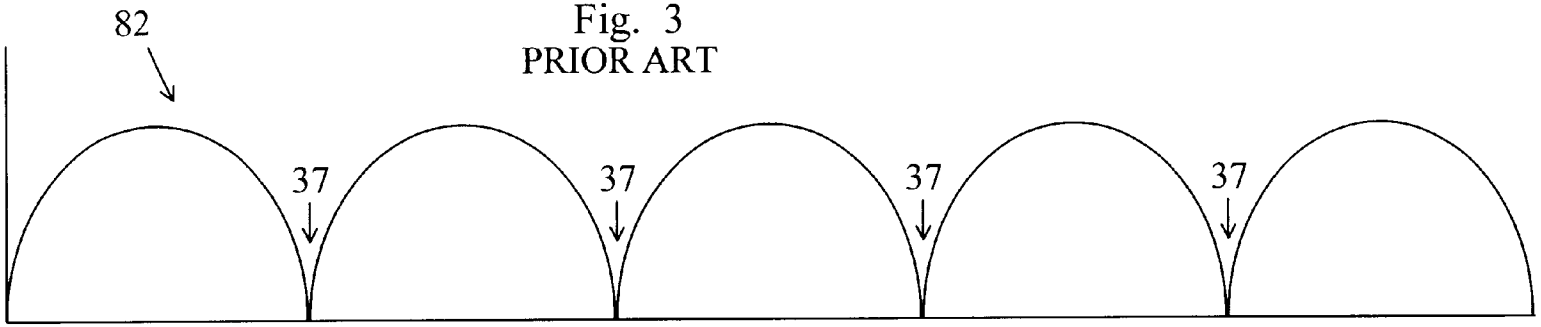
Fig. 3 PRIOR ART
FIG. 3 is a rectified voltage diagram of the prior art without valley fill correction.

FIG. 3 shows a rectified voltage, denoted by 82, on the line 34 without the valley fill correction of the present invention. The rectified voltage 82 includes nulls for the cyclic low voltages 37. The rectified voltage 82 is essentially the absolute level of a sine wave passing through zero at the nulls.

FIG. 4 shows the rectified voltage, denoted by 84, on the line 34 with the valley fill correction. The rectified voltage 84 has the cyclic high voltages 66 and the voltage pedestals 57. The voltage pedestals 57 cover the cyclic low voltages 37 during the low voltage time periods 58 of the rectified voltage on the line 34 with the valley fill correction voltage from the valley fill circuit 16. Preferably, the ratio of the voltage pedestals 57 to the peaks of the high voltage 66 of the rectified voltage 84 is about one-half.

FIG. 5 shows current, denoted by 87, pulled from the AC power line 32. No line current is pulled during the low voltage time periods 58.

FIG. 6 shows the lamp current 74 through the lamp 30. The current 74 has the high currents 75 and the boost currents 59. The boost currents 59 result from the valley fill frequency modulation during the low voltage time periods 58.

Figure 7:
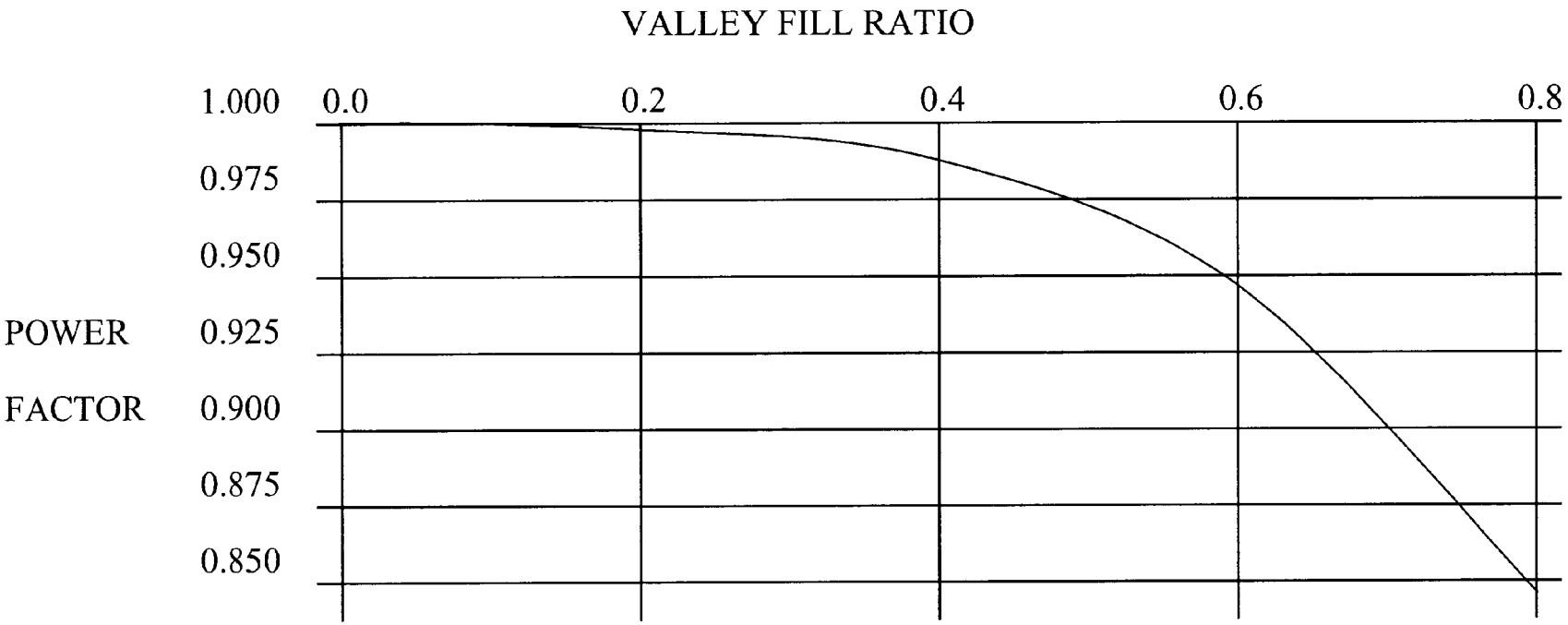
FIG. 7 is a graph of power factor versus valley fill correction of the ballast of FIG. 1.

FIG. 7 shows power factor placed on the AC power line 32 at mid line level versus a ratio of the level of the voltage pedestals 57 to the level of the peaks of the rectified voltage 84. The power factors are shown on a vertical axis as 1.000 to 0.850 for pedestal/peak ratios on the horizontal axis of 0.0 to 0.8. A ratio of zero causes no degradation of the power factor so the power factor is 1.0. A ratio less than 0.5, for example a 200 volt pedestal and a 400 volt peak, results in a power factor that is better than about 0.97.

Figure 8:
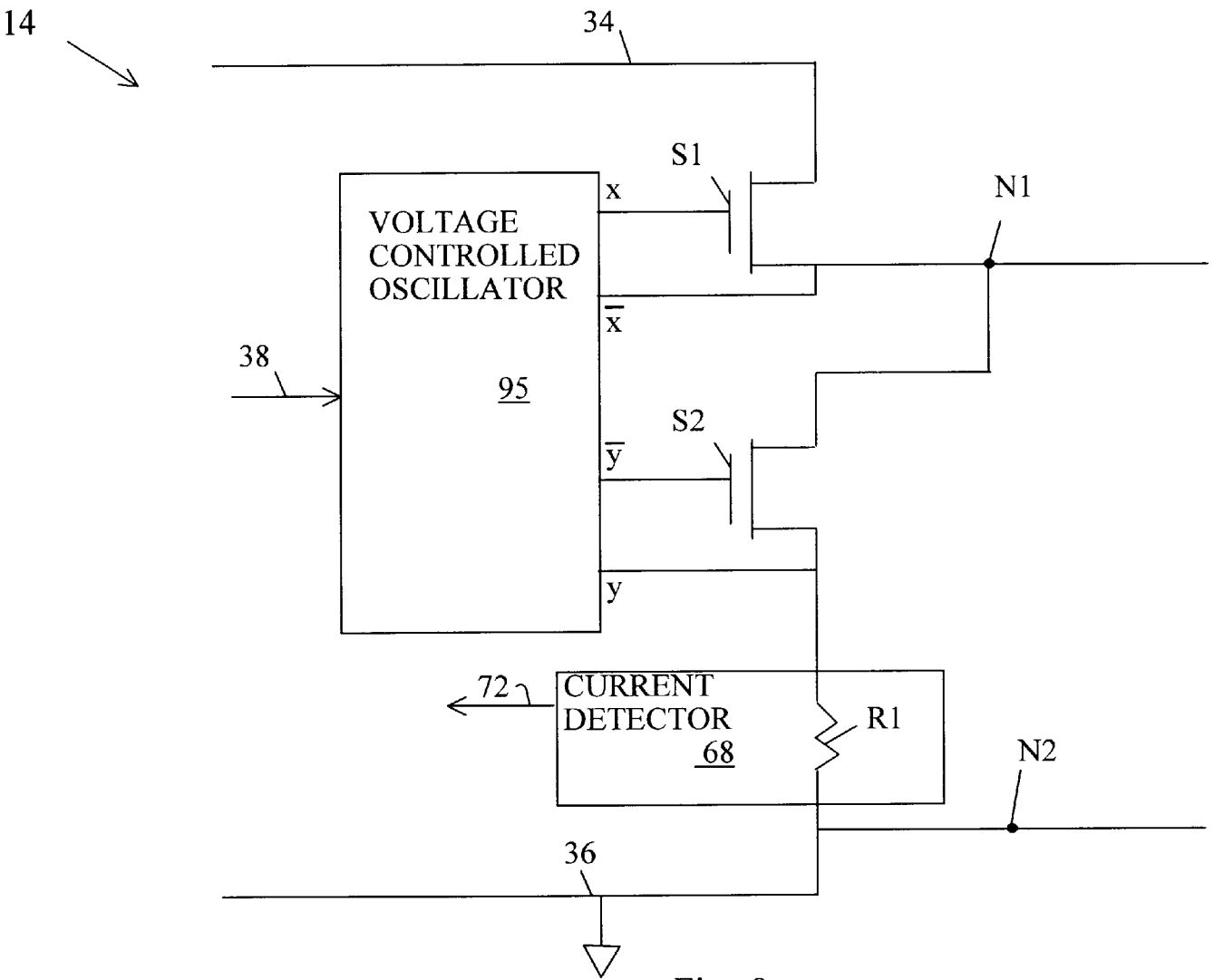
FIG. 8 is a circuit diagram of a variable frequency power generator of the ballast of FIG. 1.

FIG. 8 is a simplified diagram of the power generator 14. The power generator 14 includes a voltage controlled oscillator (VCO) 95, a series switch S1, a shunt switch S2, and a resistor R1. Preferably, the switches S1 and S2 are power MOSFETs, for example models IRFPS37N50A. The VCO 95 issues x and x bar square wave drive voltages, where bar indicates the opposite phase, to the series switch S1 to open and close between the rectified voltage on the line 34 and the circuit node N1, thereby chopping or switching or the rectified voltage 84 on and off for providing the generator signal.

The VCO 95 also issues y and y bar square wave drive voltages to the shunt switch S2 to open and close between the circuit node N1 and the resistor R1. The resistor R1 connects the shunt switch S2 to the circuit node N2. The x and y square wave voltages have the opposite phase. The effect of the phasing of the square wave drive voltages and the opening and closing of the switches S1 and S2 is to switch the rectified voltage on the line 34 on and off across the nodes N1 and N2 for providing the generator signal. The current detector 68 (FIG. 1) detects the voltage across the resistor R1 to provide the detected current signal 72. Preferably the resistor R1 has a very low resistance, for example 0.05 Ohms.

Figure 9:
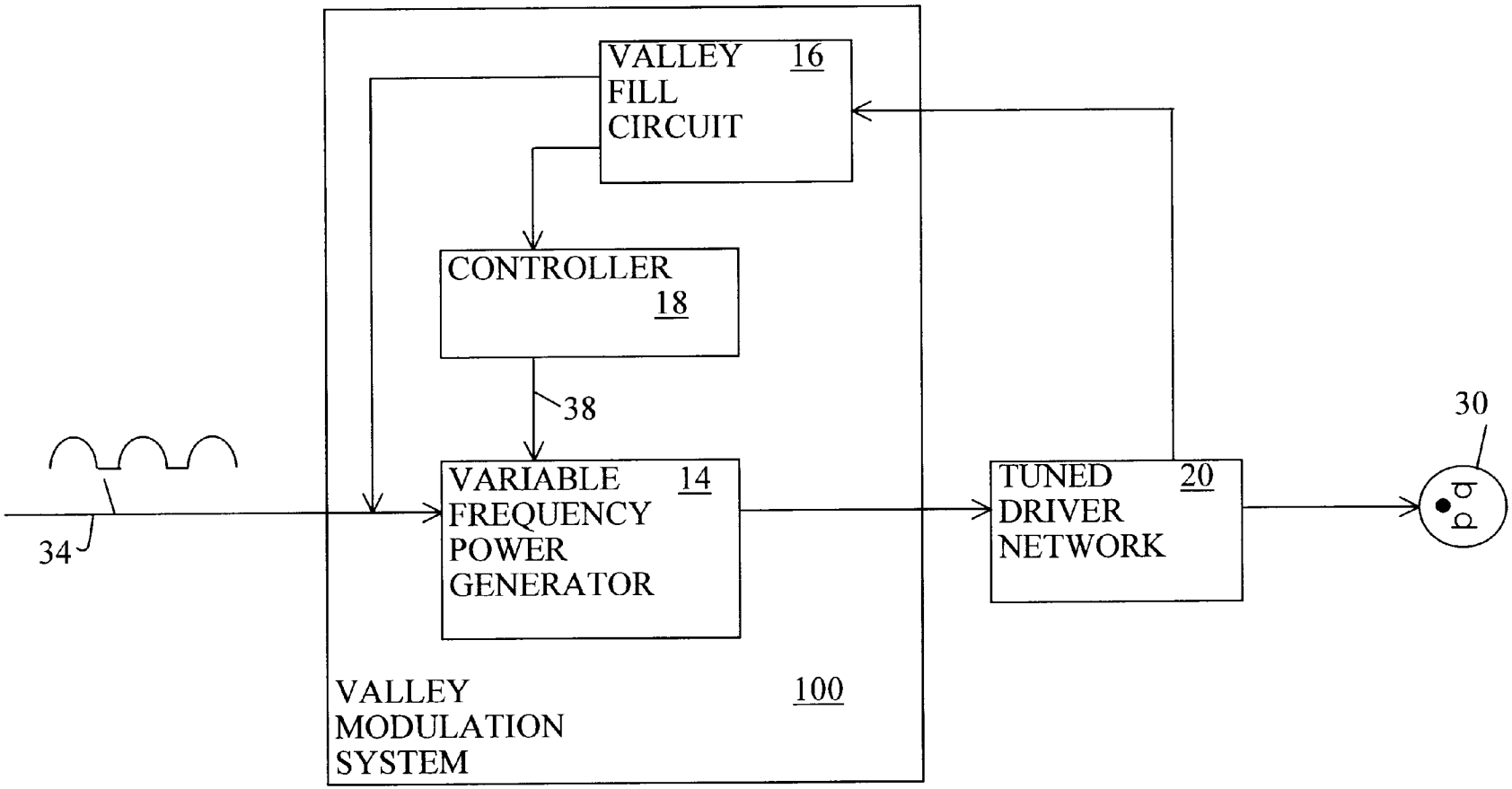
FIG. 9 is a block diagram of a valley correction modulation system of the ballast of FIG. 1.

FIG. 9 is a block diagram showing a valley frequency modulation system 100 of the present invention using frequency modulation for compensating for low voltage of the voltage pedestals 57 (FIG. 4) in the rectified voltage on the line 34. The valley frequency modulation system 100 includes the power generator 14, the valley fill circuit 16, and the controller 18. The power generator 14 receives the rectified signal on the line 34 and the frequency control signal 38 and provides the generator signal having the modulated lamp frequency to the network driver 20. The network driver 20 drives the lamp 30 and provides the input or feedback current to the valley fill circuit 16. The valley fill circuit 16 provides the valley fill current for the voltage pedestals 57 (FIG. 4) and a valley detect signal to the controller 18 during the low voltage time periods 58 when the valley fill current is flowing. The controller 18 uses the valley detect signal for providing the frequency control signal 38. The frequency control signal 38 adjusts the operating lamp frequency closer to the operating resonant frequency in order to compensate for the lower voltages of the voltage pedestals 57 during the low voltage time periods 58.

Figure 10:
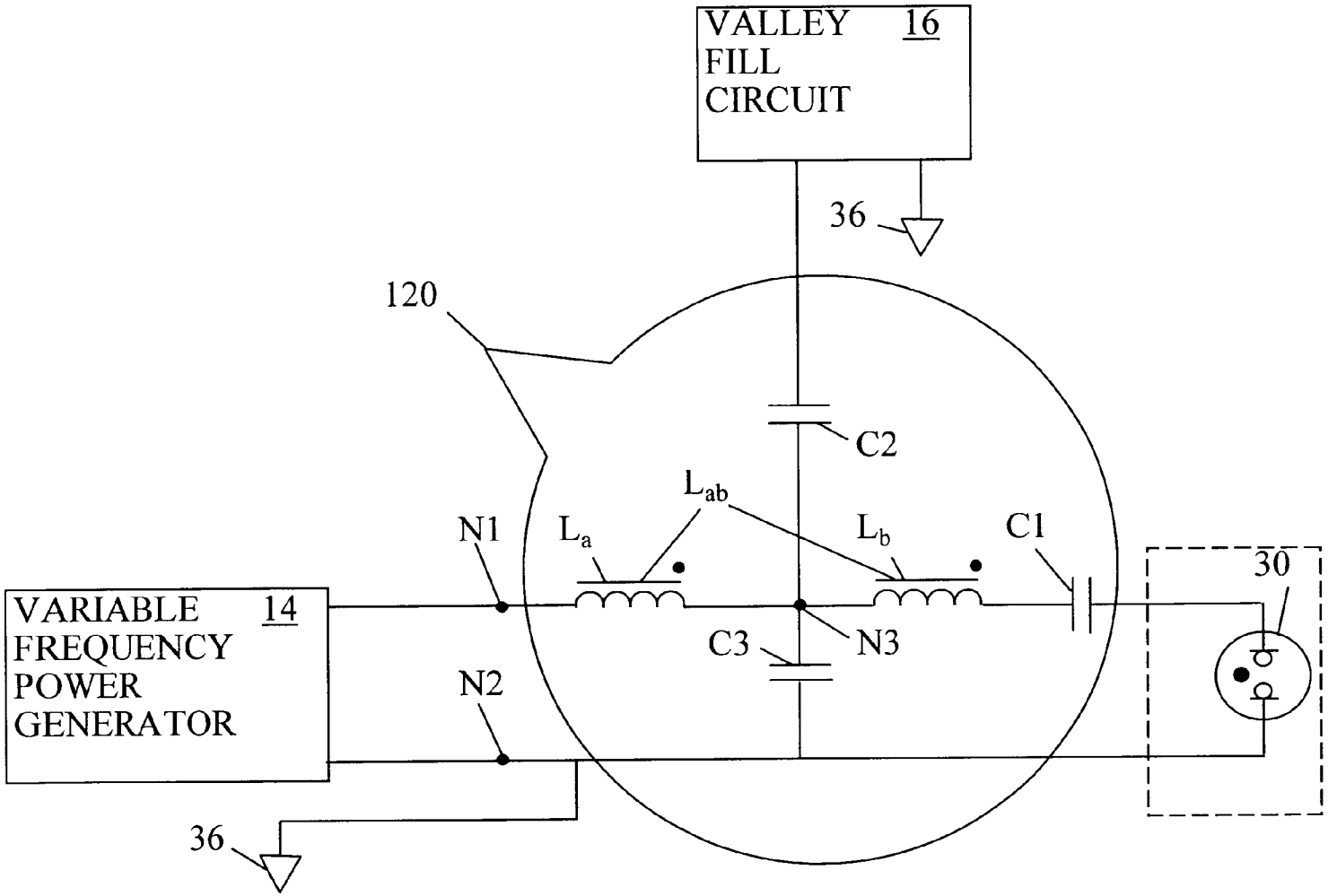
FIG. 10 is an electrical diagram of an alternative lamp driver network for the ballast of FIG. 1.

FIG. 10 is an electrical diagram of a second embodiment of a tuned lamp driver network of the present invention referred to by a reference number 120. The driver network 120 receives the generator signal from the variable frequency power generator 14 for driving the lamp 30 and providing the feedback current to the valley fill circuit 16 as described above for the driver network 20.

The driver network 120 includes the first, second and third capacitors C1–3. The second and third capacitors C2 and C3 form the effective capacitance 44 (FIG. 2A). The inductor L described above for the driver network 20 is replaced for the driver network 120 by a mutually coupled inductor $L_{ab}$ having a first mutually coupled inductor section $L_a$ and a second mutually coupled inductor section $L_b$. The first mutually coupled inductor section $L_a$ connects between the first circuit node N1 and the third circuit node N3. The second mutually coupled inductor section $L_b$ connects between the third circuit node N3 and the second circuit node N2 in series with the first capacitor C1 and the lamp 30. In a preferred embodiment the coupling ratio is 1:1.

Figure 11B:
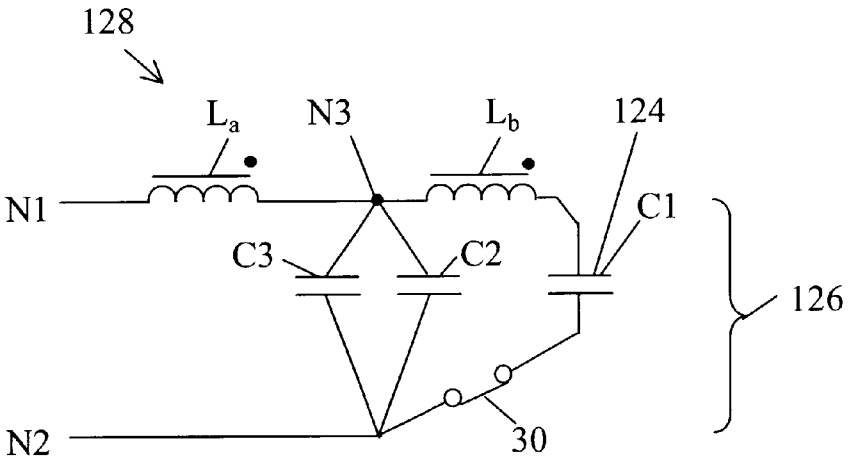
FIGS. 11A and 11B are circuit diagrams of the lamp driver network of FIG. 10 for starting and operating the lamp, respectively.
Figure 11A:
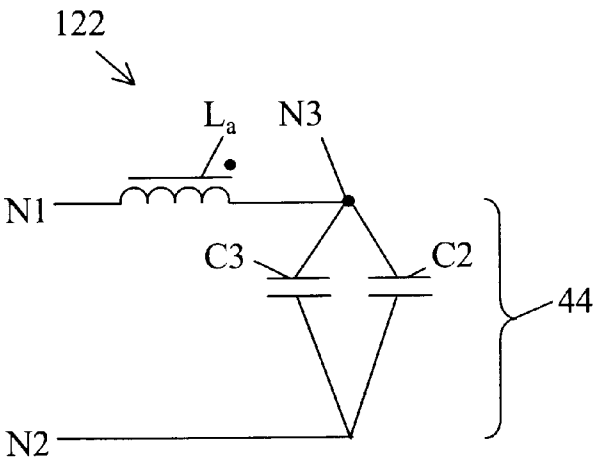

Referring to FIGS. 11A and 11B, before ignition when the lamp 30 is off, a starting serial circuit 122 is formed between the nodes N1 and N2 by the first mutually coupled inductor section $L_a$ in series with the effective capacitance 44 between the nodes N3 and N2 for the first resonant frequency or "starting resonant frequency". After ignition when the lamp 30 is conducting, an effective capacitance 124 that is approximately the capacitance of the first capacitor C1 times a factor that depends upon the turns ratio of the second to first mutually coupled inductor sections $L_a$ and $L_b$ is added in parallel to the second and third capacitors C2 and C3 to form an effective capacitance 126 between the nodes N3 and N2. The first mutually coupled inductor section $L_a$ in series with the effective capacitance 126 forms an operating serial circuit 128 between the nodes N1 and N2. The operating serial circuit 128 has the second resonant frequency or "operating resonant frequency".

The first or starting resonant frequency of the driver network 120 is lower than the second or operating resonant frequency. As an exemplary case, the first or starting resonant frequency is about 50 kHz and the second or operating resonant frequency is about 80 kHz. The starting lamp frequency should be within about ±10 of the first or starting resonant frequency and the operating lamp frequency should be within about ±25 of the second or operating resonant frequency. An effect of the mutually coupled inductor $L_{ab}$ is to increase the starting and operating voltages at the third node N3 to higher levels for driving the lamp 30. The higher levels may be required for utility power of 120 VAC rms (as opposed to the 200 to 304 VAC rms given above) on the AC power line 32.

Although the present invention has been described in terms of the presently preferred embodiments, it is to be understood that such disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. An electronic ballast, comprising:

a driver network for receiving a generator signal for driving a lamp, the driver network tuned to a first resonant frequency when said lamp is off and tuned to a second resonant frequency when said lamp is on, said first resonant frequency not equal to said second resonant frequency, the driver network including an inductor and a first effective capacitance serially disposed across said generator signal for receiving said generator signal and providing said first resonant frequency when said lamp is off; and a first capacitor serially disposed between said lamp and a node between said inductor and said first effective capacitance for driving said lamp, said first effective capacitance and a capacitance dependent upon said first capacitor operating in parallel for forming a second effective capacitance when said lamp is operating, said inductor and said second effective capacitance for providing said second resonant frequency; and a variable frequency power generator for issuing said generator signal at a lamp frequency controlled by a frequency control signal, said lamp frequency being a starting lamp frequency corresponding to said first resonant frequency for starting said lamp and an operating lamp frequency corresponding to said second resonant frequency for operating said lamp.

2. The ballast of claim 1, wherein:

said starting lamp frequency is in a range of 0.9 to 1.1 times said first resonant frequency.

3. The ballast of claim 1, wherein:

said operating lamp frequency is in a range of 0.75 to 1.25 times said second resonant frequency.

4. The ballast of claim 1, wherein:

the driver network is tuned to said first resonant frequency by a high impedance of said lamp when said lamp is off and to said second resonant frequency by a low impedance of said lamp when said lamp is on.

5. The ballast of claim 1, wherein:

the power generator adjusts said operating lamp frequency closer to said second resonant frequency for brightening said lamp and farther from said second resonant frequency for dimming said lamp.

6. The ballast of claim 1, wherein:

the same single said inductor in combination with said first and second effective capacitances provides said first and second resonant frequencies, respectively.

7. The ballast of claim 1, wherein:

said inductor includes first and second mutually coupled inductor sections, said first mutually coupled inductor section serially disposed with said first effective capacitance for receiving said generator signal, said second mutually coupled inductor section serially disposed with said first capacitor and said lamp for boosting voltage from said node to said lamp.

8. The ballast of claim 1, wherein:

the power generator receives a rectified power signal having cyclic low voltages;

said first effective capacitance includes a second capacitor connecting said node to a valley fill circuit; and said valley fill circuit receives a feedback current through said second capacitor and provides a valley fill current to the power generator during said low voltages.

9. The ballast of claim 8, wherein:

the power generator chops said rectified power signal at said starting lamp frequency and then at said operating lamp frequency for providing said generator signal.

10. An electronic ballast, comprising:

a driver network for receiving a generator signal for driving a lamp, the driver network tuned to a first resonant frequency when said lamp is off and tuned to a second resonant frequency when said lamp is on, said first resonant frequency not equal to said second resonant frequency, the driver network including an inductor, a first capacitor, a second capacitor, a third capacitor, and first, second and third nodes; said generator signal received across said first node and said second node; said inductor connected between said first node and said third node; said first capacitor serially connected with said lamp between said third node and said second node; said third capacitor connected between said third node and said second node; and said second capacitor connected for passing feedback current from said third node to a valley fill circuit; and a variable frequency power generator for issuing said generator signal at a lamp frequency controlled by a frequency control signal, said lamp frequency being a starting lamp frequency corresponding to said first resonant frequency for starting said lamp and an operating lamp frequency corresponding to said second resonant frequency for operating said lamp, said valley fill circuit for providing a valley fill current to said power generator for augmenting said generator signal.

11. The ballast of claim 10, wherein:

said starting lamp frequency is in a range of 0.9 to 1.1 times said first resonant frequency.

12. The ballast of claim 10, wherein:

said operating lamp frequency is in a range of 0.75 to 1.25 times said second resonant frequency.

13. The ballast of claim 10, wherein:

the driver network is tuned to said first resonant frequency by a high impedance of said lamp when said lamp is off and to said second resonant frequency by a low impedance of said lamp when said lamp is on.

14. The ballast of claim 10, wherein:

the power generator adjusts said operating lamp frequency closer to said second resonant frequency for brightening said lamp and farther from said second resonant frequency for dimming said lamp.

15. An electronic ballast, comprising:

a driver network for receiving a generator signal for driving a lamp, the driver network tuned to a first resonant frequency when said lamp is off and tuned to a second resonant frequency when said lamp is on, said first resonant frequency not equal to said second resonant frequency, the driver network including a first capacitor, a second capacitor, a third capacitor, an inductor having a first mutually coupled inductor section and a second mutually coupled inductor section, and first, second and third nodes; said generator signal received across said first node and said second node; said first mutually coupled inductor section connected between said first node and said third node; said first capacitor and said second mutually coupled inductor section connected in series with said lamp between said third node and said second node; said third capacitor connected between said third node and said second node; said second capacitor connected for passing feedback current from said third circuit node to a valley fill circuit; and a variable frequency power generator for issuing said generator signal at a lamp frequency controlled by a frequency control signal, said lamp frequency being a starting lamp frequency corresponding to said first resonant frequency for starting said lamp and an operating lamp frequency corresponding to said second resonant frequency for operating said lamp, said valley fill circuit for providing a valley fill current to said power generator for augmenting said generator signal.

16. The ballast of claim 15, wherein:

said starting lamp frequency is in a range of 0.9 to 1.1 times said first resonant frequency.

17. The ballast of claim 15, wherein:

said operating lamp frequency is in a range of 0.75 to 1.25 times said second resonant frequency.

18. The ballast of claim 15, wherein:

the driver network is tuned to said first resonant frequency by a high impedance of said lamp when said lamp is off and to said second resonant frequency by a low impedance of said lamp when said lamp is on.

19. The ballast of claim 15, wherein:

the power generator adjusts said operating lamp frequency closer to said second resonant frequency for brightening said lamp and farther from said second resonant frequency for dimming said lamp.

20. A method for powering a lamp, comprising:

tuning to a first resonant frequency when said lamp is off and a second resonant frequency when said lamp is on;

issuing a frequency control signal; and issuing a generator signal having a lamp frequency set by said frequency control signal to a starting lamp frequency corresponding to said first resonant frequency for starting said lamp and adjusted to an operating lamp frequency corresponding to said second resonant frequency for driving said lamp when said lamp is operating, wherein tuning includes steps of receiving said generator signal across an inductor and a first effective capacitance disposed in series for providing said first resonant frequency when said lamp is off; receiving said generator signal across an inductor and a second effective capacitance disposed in series for providing said second resonant frequency when said lamp is on; and driving said lamp through a first capacitor serially disposed with said lamp, said first effective capacitance and a capacitance dependent upon said first capacitor forming said second effective capacitance when said lamp is on.

21. The method of claim 20, wherein:

said starting lamp frequency is in a range of 0.9 to 1.1 times said first resonant frequency.

22. The method of claim 20, wherein:

said operating lamp frequency is in a range of 0.75 to 1.25 times said second resonant frequency.

23. The method of claim 20, wherein:

the step of tuning includes using a high impedance of said lamp when said lamp is off for tuning to said first resonant frequency, and using a low impedance of said lamp when said lamp is on for tuning to said second resonant frequency.

24. The method of claim 20, wherein:

the step of issuing said generator signal includes setting said operating lamp frequency closer to said second resonant frequency for brightening said lamp and farther from said second resonant frequency for dimming said lamp.

25. The method of claim 20, wherein:

the same single said inductor in combination with said first and second effective capacitances provides said first and second resonant frequencies, respectively.

26. The method of claim 20, wherein:

said inductor includes first and second mutually coupled inductor sections; and the step of tuning further includes steps of receiving said generator signal across said first mutually coupled inductor section and a first effective capacitance disposed in series for providing said first resonant frequency when said lamp is off; receiving said generator signal across said first mutually coupled inductor and a second effective capacitance disposed in series for providing said second resonant frequency when said lamp is on; and driving said lamp through said second mutually coupled inductor section and a first capacitor disposed in series with said lamp, said first effective capacitance and a capacitance dependent upon said first capacitor and forming said second effective capacitance when said lamp is on.

27. The method of claim 20, further comprising:

receiving a rectified power signal having cyclic low voltages;

using said rectified power signal for generating said generator signal;

passing a feedback current from said node through a second capacitor, said second capacitor a part of said first effective capacitance; and using said feedback current for providing a valley fill current during said low voltages.

28. The method of claim 27, wherein:

the step of generating said rectified power signal for issuing said generator signal includes switching said rectified power signal on and off for providing said generator signal at said starting lamp frequency and then said operating lamp frequency.

29. A method for powering a lamp, comprising:

tuning to a first resonant frequency when said lamp is off and a second resonant frequency when said lamp is on;

issuing a frequency control signal; and issuing a generator signal having a lamp frequency set by said frequency control signal to a starting lamp frequency corresponding to said first resonant frequency for starting said lamp and adjusted to an operating lamp frequency corresponding to said second resonant frequency for driving said lamp when said lamp is operating, wherein tuning includes steps of receiving said generator signal between a first node and a second node, connecting an inductor between said first node and a third node; serially connecting a first capacitor and said lamp between said third node and said second node; connecting a third capacitor between said third node and said second node; and connecting a second capacitor for passing a feedback current from said third node, said feedback current used for providing a valley fill current for augmenting said generator signal.

30. The method of claim 29, wherein:

said starting lamp frequency is in a range of 0.9 to 1.1 times said first resonant frequency.

31. The method of claim 29, wherein:

said operating lamp frequency is in a range of 0.75 to 1.25 times said second resonant frequency.

32. The method of claim 29, wherein:

the step of tuning includes using a high impedance of said lamp when said lamp is off for tuning to said first resonant frequency, and using a low impedance of said lamp when said lamp is on for tuning to said second resonant frequency.

33. The method of claim 29, wherein:

the step of issuing said generator signal includes setting said operating lamp frequency closer to said second resonant frequency for brightening said lamp and farther from said second resonant frequency for dimming said lamp.

34. A method for powering a lamp, comprising:

tuning to a first resonant frequency when said lamp is off and a second resonant frequency when said lamp is on;

issuing a frequency control signal; and issuing a generator signal having a lamp frequency set by said frequency control signal to a starting lamp frequency corresponding to said first resonant frequency for starting said lamp and adjusted to an operating lamp frequency corresponding to said second resonant frequency for driving said lamp when said lamp is operating, wherein tuning includes steps of receiving said generator signal between a first node and a second node, connecting a first inductor section between said first node and a third node; serially connecting a first capacitor, a second inductor section mutually coupled to said first inductor section and said lamp between said third node and said second node; connecting a third capacitor between said third node and said second node; and connecting a second capacitor for passing feedback current from said third circuit node, said feedback current used for providing a valley fill current for augmenting said generator signal.

35. The method of claim 34, wherein:

said starting lamp frequency is in a range of 0.9 to 1.1 times said first resonant frequency.

36. The method of claim 34, wherein:

said operating lamp frequency is in a range of 0.75 to 1.25 times said second resonant frequency.

37. The method of claim 34, wherein:

the step of tuning includes using a high impedance of said lamp when said lamp is off for tuning to said first resonant frequency, and using a low impedance of said lamp when said lamp is on for tuning to said second resonant frequency.

38. The method of claim 34, wherein:

the step of issuing said generator signal includes setting said operating lamp frequency closer to said second resonant frequency for brightening said lamp and farther from said second resonant frequency for dimming said lamp.

* * * * *